United States Patent [19]

Ogawa

[11] 4,167,830

[45] Sep. 18, 1979

[54] RANDOM INDICATOR AMPHIBIOUS VEHICLE ASSEMBLY

[75] Inventor: Iwakichi Ogawa, Kashiwa, Japan

[73] Assignee: Takara Co., Ltd., Tokyo, Japan

[21] Appl. No.: 794,350

[22] Filed: May 6, 1977

[51] Int. Cl.[2] ..... A63H 17/00; A63H 23/04; A63H 33/06

[52] U.S. Cl. ..... 46/17; 46/96; 46/202; 273/142 R

[58] Field of Search ..... 46/17, 16, 202, 249, 46/250, 251, 96; 273/142 R, 142 H, 142 HA, 142 JC, 142 JD, 142 J

[56] References Cited

U.S. PATENT DOCUMENTS

| | | | |
|---|---|---|---|
| 1,970,177 | 8/1934 | Lehmann | 273/142 R |
| 2,262,891 | 11/1941 | Gortner | 273/142 R X |
| 2,548,837 | 4/1951 | Wright | 273/142 H |
| 2,749,660 | 6/1956 | Zimenstark | 46/17 X |
| 2,755,596 | 7/1956 | Weil | 46/202 X |
| 2,775,062 | 12/1956 | Gibson et al. | 46/96 |
| 2,864,613 | 12/1958 | Porter | 46/17 X |
| 3,392,484 | 7/1968 | Ryan et al. | 46/202 |
| 3,466,798 | 9/1969 | Speers et al. | 46/250 |
| 3,733,739 | 5/1973 | Terzian | 46/96 X |
| 3,738,052 | 6/1973 | Kelly | 46/202 X |

FOREIGN PATENT DOCUMENTS

| | | | |
|---|---|---|---|
| 450681 | 7/1949 | Italy | 46/93 |

*Primary Examiner*—F. Barry Shay
*Attorney, Agent, or Firm*—Jackson, Jones & Price

[57] ABSTRACT

A combination toy assembly having individual removable component parts is provided to form a versatile toy for a child. Mounted within the body member is a randomly activated indicator member capable of providing random values for a game of chance and the like. Various forms of power devices can be appended to the body member for locomotion such as a motor with a pair of drive wheels and a waterproof motor assembly with a propeller. Pontoons and a float member can be attached to the body member to permit the mobile toy to operate in water. An articulated extension member can be mounted on the rear of the body member to provide a tail stabilizer or simulated antenna, or can be further bent and mounted on the top of the body member to provide a simulated steering column.

18 Claims, 6 Drawing Figures

8
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
A

RANDOM INDICATOR AMPHIBIOUS VEHICLE ASSEMBLY

BACKGROUND OF THE INVENTION

1. Field of the Invention

The present invention is directd to the toy industry and more particularly to a mobile toy assembly that incorporates a random indicator device in the body of the toy.

2. Description of the Prior Art

The toy industry has provided a large number of various mobile toys for children. These toys are generally limited in the number of play options available for the child.

The prior art is still receptive to toys that provide a large number of play options to help satisfy a child's limited span of attention.

SUMMARY OF THE INVENTION

The present invention provides a mobile toy and random inicator or selector device combination that can be used both in water and on land. The toy body or base member is combined with a plurality of appended component parts that are removably attached to facilitate locomotion. The body member can further have a configuration which simulates a hand-held two-way microphone.

A rotatable indicator or indicia member can be appropriately mounted within the body member to provide a plurality of preselected values. An actuator rack member is movably mounted on the body member and can be depressed to activate the rotation of the indicia member to cause random relative movement.

An articulate extension member can be mounted on either the rear or top surface of the body member to provide a variable play option.

Various forms of auxiliary motor devices can also be attached to the body member for driving it both on land and in water. The objects and features of the present invention, which are believed to be novel, are set forth with particularity in the appended claims. The present invention, both as to its organization and manner of operation together with further objects and advantages thereof, may best be understood by reference to the following description, taken in connection with the accompanying drawings.

DESCRIPTION OF THE PREFERRED EMBODIMENT

The following description is provided to enable any person skilled in the toy industry to make and use the inventions and it sets forth the best modes contemplated by the inventor by carrying out his invention. Various modifications, however, will remain readily apparent to those skilled in the above art, since the generic principles of the present invention have been defined herein specifically to provide a relatively economical and easily manufactured mobile toy assembly.

Figure 2:
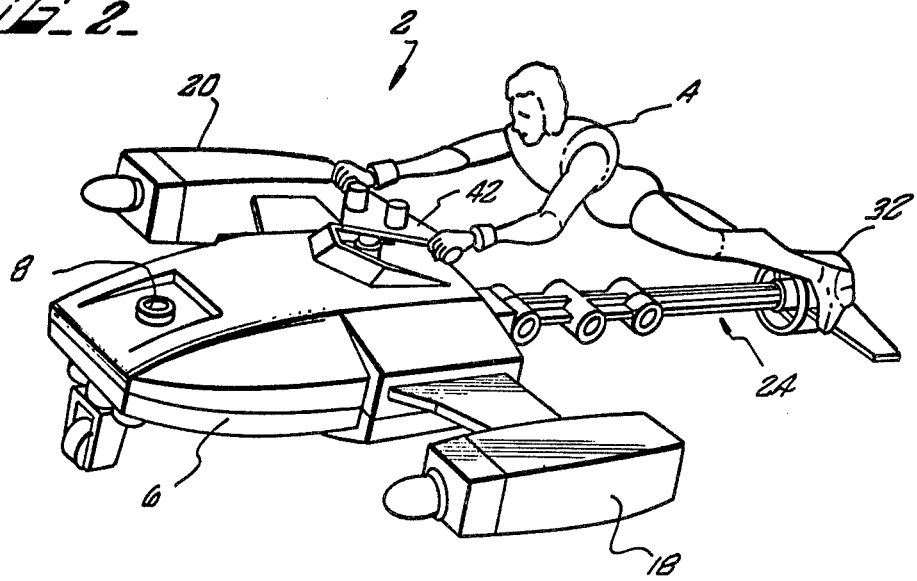
FIG. 2 is an assembled side perspective view of FIG. 1.

Referring to FIG. 2, a perspective view of the mobile toy assembly 2 of the present invention is disclosed. The dimensions of the mobile toy assembly and the component auxiliary parts that can be attachable thereto, are designed to be compatible with a figurine doll 4 and a complimentary line of interchangeable toys. The mobile toy assembly is advantageously formed by an injection molded plastic process and has been specifically designed to minimize the production and assembly time required. As can be readily appreciated, various indicia and surface markings can be molded into the parts for esthetic effect or to simulate controls, vehicle features, etc.

Figure 3:
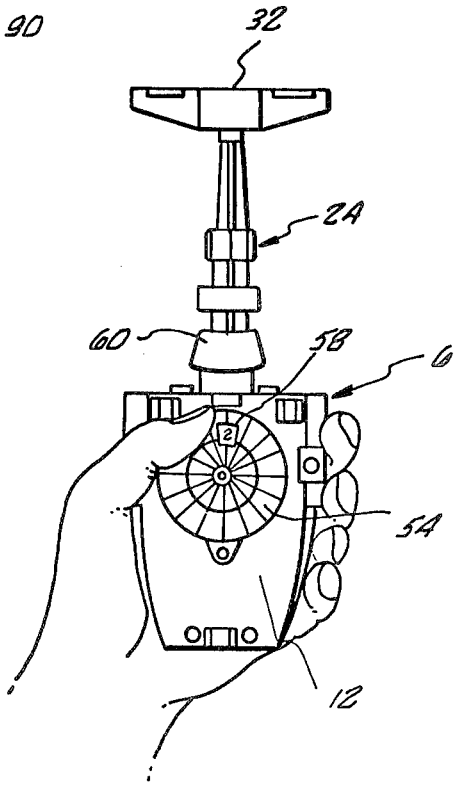
FIG. 3 is a side view of a hand microphone embodiment of the present invention.

The base or body member 6 has a plurality of surface female coupling apertures 8 adapted to receive various appended component parts in a press fit or frictional engagement. The body member 6, as can be seen in FIG. 3 has a configuration that has been purposely designed to simulate a hand-held two-way microphone when the appended component parts are removed.

Figures 1, 5, 6:
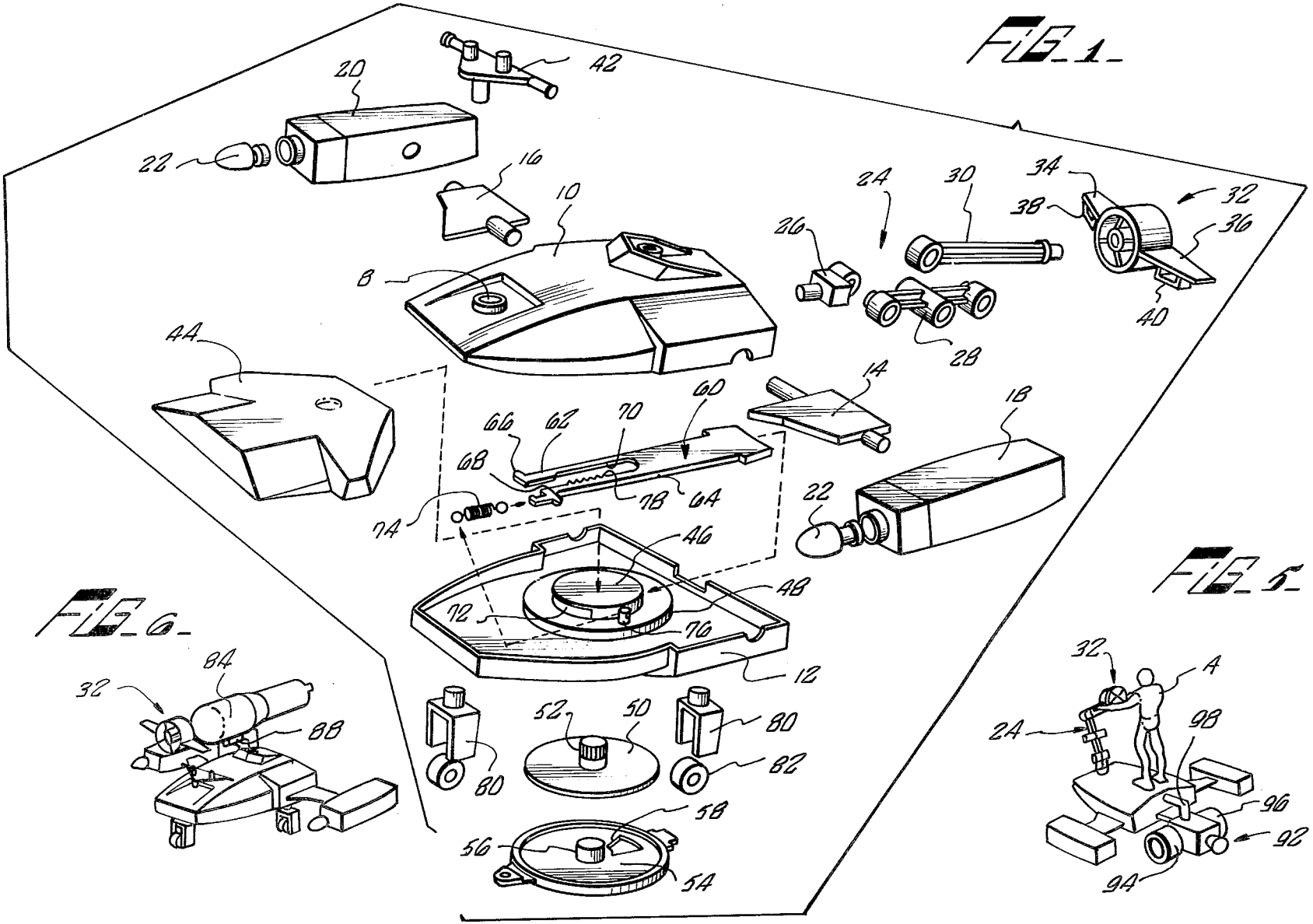
FIG. 1 is an exploded side perspective view of one embodiment of the present invention.
FIG. 5 is a schematic rear side perspective view of an additional embodiment of the present invention.
FIG. 6 is a schematic front side perspective view of still another embodiment of the present invention.

Referring to FIG. 1, the base member can be subdivided into an upper and lower housing shell 10 and 12 respectively. The housing shells 10 and 12 are assembled together, with appropriate fasteners such as screws (not shown). Wing members 14 and 16 can be appended to either side of the body member 6. Wing pads or pontoons 18 and 20 can be press fitted on male studs extending from the respective wing members. A bullet or rocket shaped member 22 can be mounted in a forward aperture in each of the pontoons to simulate a firing mechanism. The pontoons are hollow and can assist in the floatation of the toy assembly as will be subsequently described.

A multifunctional articulated extension member 24 can be mounted on the body member 6 and includes a first coupling member 26 having a protruding male stud for a press fit mounting in any of the female coupling apertures on the body member 6. A female joint is provided on the other side of the coupling member 26 and is designed to receive a male stud on an intermediate extension member 28 and to permit relative rotation, if desired. Finally, an extension shaft 30 includes an appropriate female coupling member at one end and a male stud at the other end to receive a tail member 32. The tail member 32 has a pair of side wings 34 and 36 suspended from a cylinder shaped housing.

Mounting brackets 38 and 40 are appended on the bottom side of each of the respective side wings. As can be seen in FIG. 5, the hands of the figurine doll 4 can be attached to these mounting brackets 38 and 40 when the articulated extension member 24 is mounted on the upper surface of the body member 6 to simulate a steering column. A more conventional handle bar steering assembly 42 can be appropriately mounted within an appropriate female aperture on the top of body member 6, as shown in FIG. 2.

Sandwiched within the upper and lower housing shells 10 and 12, is a sealed plastic float member 44 which increases the buoyancy of the body member 6 so that it will float in water even with appended members and motor assemblies.

Referring to FIG. 1, the lower housing shell 12 has a pair of concentric circular recesses 46 and 48 on its exterior surface. The surface of the circular recess 48 provides an alignment plane for a rotatable indicia member 50. The indicia member 50 is basically a circular flat disk having a protruding pinion gear 52 mounted on its center. The pinion gear 52 is dimensioned to extend into the lower circular recess 46. A retaining faceplate 54 has a central bearing member 56 and an aperture 58. The bearing member 56 assists in maintaining the position of the rotatable indicia member 50 within the circular recess 46 while the aperture 58 is aligned to disclose preselected indicia that will be randomly displayed. The specific indicia can be subjectively varied as desired.

The means for activating the indicia member 50 to cause the random relative movement is a bifurcated rack member 60 having at one end an arcuate enlarged actuator head to provide a limit of travel of the rack member 60 into the body member 6. At the other end of the rack member 60 are a pair of rack prong legs 62 and 64 respectively ending in a pair of exterior locking cam members 66 and 68 respectively. An oval slot 70 between the legs 62 and 64 is designed to capture the pinion gear 52 when the rack member 60 is inserted through a pair of square aperture openings 72 diammetrically positioned in the walls of the lower circular recess 46.

During assembly, the rack member 60 is passed through the respective square aperture openings while its respective prong legs 62 and 64 are depressed. When the prong legs 62 and 64 pass through the second square aperture opening 72 they expand so that the locking cam member 66 and 68 coact with the edge of the aperture opening. A spring member 74 is mounted on a stud member 76 and also on one leg 64 of the rack member 60 to bias the rack member 60 into an extended position out of the body member 6. Depression of the extended rack member 60 causes gear teeth 78 on the interior of the rack prong leg 64 to drivingly intermesh with the pinion gear 52 on the indicia member 50. Since the indicia member 50 is captured in the circular recess 48, it is constrained to rotate in the circular recess. The dimensions of the circular recess and the indicia member 50 are such that it spins freely whereby a preselected value will appear at the aperture 58 when the indicia member 50 stops rotating.

Three wheel mountings 80 are provided and have primarily a U-shaped configuration with a minor degree of resiliency to capture respective wheels 82. The wheel mountings 80 have appropriate male coupling studs for a press fit removable mounting in appropriate female coupling apertures on the body member 6.

Figure 4:
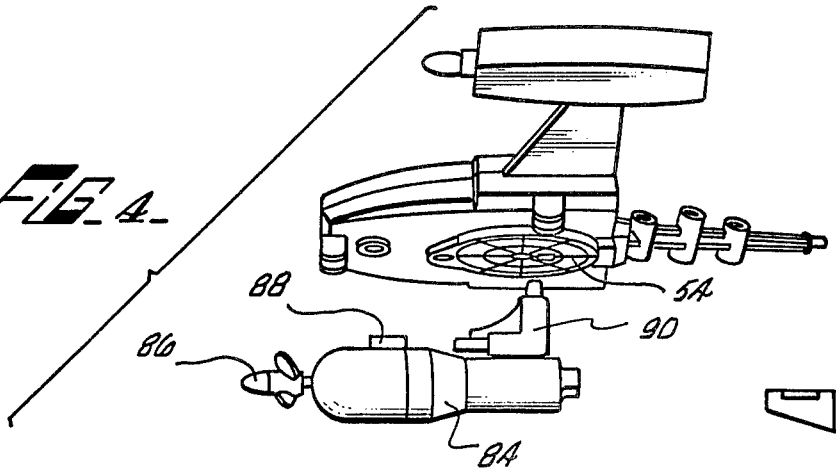
FIG. 4 is a bottom side perspective view of still another embodiment of the present invention.

As can be seen in FIG. 4, a watertight motor assembly 84 having an output shaft mounting a propeller 86 can be suspended by its mounting bracket 88 from either the top or bottom of the body member 6. An L-shaped coupling member 90 can be utilized to attach the motor assembly 84 to the body member 6. The watertight motor assembly 84 can contain a battery to provide independent locomotion for the mobile toy. The watertight motor assembly 84 can be of the type described in U.S. Pat. No. 3,477,173.

An alternative mounting of the motor assembly 84 is seen in FIG. 6, wherein the tail member 32 is operatively mounted to the motor shaft by, for example, a press fit or an intermediate coupling member (not shown) for rotation on the top front of the body member.

Referring to the embodiment of FIG. 3, the appended component parts that are removably attached to the body member 6 and for example facilitate locomotion have been removed with the exception of the articulated extension member 24 and the tail member 32. These members are attached to the rear surface of the body member 6 to give the appearance of an antenna to compliment the simulated configuration of the body member as a hand microphone.

The articulated extension member 24 can also be mounted on the upper surface of the body member as shown in FIG. 5 and subjectively configured with the tail member 32 to provide a simulated steering column for the figurine doll 4. Additionally, a spring driven motor assembly 92 having a pair of drive wheels 94 and 96 can be mounted onto the rear surface of the body member 6. This is accomplished with an auxiliary coupling extension member 98 which is mounted into the body female coupling aperture that is available for the articulated extension member 24 when it acts as a tail member.

As described above, the mobile toy assembly 2 is amphibious in that it can operate as a vehicle on land and as a boat-like member in the water. It is also capable of independent locomotion by appropriate provision of either a water motor or a land motor assembly. Additionally, the body member 6 of the present invention has the capability of providing a random series of values that can be activated by a child to provide optional play for example in a game of chance. Additionally, the body member 6 has a configuration resembling a hand-held microphone that further increases the child's toy play options.

The child when playing with the present invention can further configure the appended component parts to provide a land vehicle having a articulated extension member extending from the vehicle rear as a tail piece as seen in FIG. 2. The figurine doll can be advantageously attached to further enchance the child's imagination of optional toy play. By removing the articulated extension member 24, and positioning it on the upper surface of the body member 6, as shown in FIG. 5, the child can then provide a standing doll figure with simulating steering of the vehicle. The accessory spring driven motor assembly 92 can also be appended to the rear of the body member 6 to drive the vehicle.

The watertight motor assembly 84 can likewise be utilized on land by mounting it on the upper surface of the body member as shown in FIG. 6 to simulate an airplane effect.

The water motor assembly 84 can also be suspended from the bottom of the body member 6 as shown in FIG. 4 to provide a floating self-driven water toy. Finally, the body member 6 can be striped of the appended component parts to simulate a hand-held microphone as shown in FIG. 3.

The various mutations of these basic toy configurations are limited only by the imagination of a child. A person skilled in this field once disclosed the principles of the present invention would also be capable of various modifications within the scope and spirit of the present invention. Accordingly, the present invention should be measured solely from the following claims in which I claim:

What is claimed is:

1. A combination amphibious mobile toy and random selector device comprising:

a base member having an aperture;

a float member, positioned within the base member, having sufficient bouyancy relative to water to float the toy;

a plurality of appended component parts attached to the base member and facilitating locomotion;

an articulated extension member removably attachable at the option of a player to means at at least a first and a second position on the base member, the articulated extension member being configured to simulate both a winged tail section of the amphibious toy and a steering column attachable to the toy, the articulated extension member comprising a tail section of the toy when optionally placed at the first position and simulating a steering column when optionally placed at the second position;

at least one indicia member having a plurality of different preselected valued indicia mounted within the base member for random movement to position an indicia for viewing through the aperture, and means for activating the indicia member to cause random relative movement whereby an operator can optionally play with the toy as a mobile unit and also as an indicator of random values for a game of chance and the like, including a spring biased member movable extending from one end of the base member and operatively connected to the indicia member to initiate random movement independent of any other locomotion of the toy.

2. The invention of claim 1 further including a removable power means for driving the toy.

3. The invention of claim 1 wherein the base member is divided into first and second shell members.

4. The invention of claim 3 wherein one of the shell members has a recessed indentation and the indicia member is rotatably mounted in the indentation.

5. The invention of claim 4 wherein the spring biased member includes a rack member extending through the recessed indentation and operatively contacting the indicia member for random rotation.

6. The invention of claim 5 wherein the rack member is bifurcated and has gear teeth on only a portion of the interior surface of one of the two rack legs.

7. The invention of claim 6 wherein the indicia member has a gear for intermeshing with the rack teeth and the ends of the rack legs have locking cam members to contact the exterior of the recessed indentation.

8. The invention of claim 2 wherein the power means is a motor with a pair of drive wheels.

9. The invention of claim 2 wherein the power means is a water sealed motor with a propeller.

10. The invention of claim 1 wherein the indicia member is a disc member with a projecting gear and the means for activating the disc member is a movably mounted spring biased bifurcated rack member having teeth for engaging the projecting gear in a driving arrangement.

11. A mobile amphibious toy assembly comprising:

a base member having upper and rear surfaces, said base member being shaped to simulate a hand-held two-way microphone, the base member being divided into first and second shell members and including a water sealed float member mounted within the shell members, one of the shell members having a recessed indentation;

means for driving the base member removably connected to the exterior surface of the base member;

a plurality of removably appended parts facilitating locomotion attached to the base member;

an articulated extension member adapted to being connected to one of the upper and rear surfaces;

at least one indicia member having a plurality of different preselected valued indicia mounted within the recessed indentation of the base member for rotatable random movement, said base member including means to disclose a randomly selected one of said indicia, and means for activating the indicia member to cause random relative movement whereby an operator can optionally play with the toy as a mobile unit and also as an indicator of random values for a game of chance and the like, the rack member being bifurcated to provide a pair of rack legs with gear teeth on only a portion of the interior surface of one of the two rack legs, the indicia member having a gear for intermeshing with the rack teeth and the ends of the rack legs having locking cam members to contact the exterior of the recessed indentation.

12. The invention of claim 11 wherein the articulated member is attached to the rear surface and further has a tail piece configuration attached to one end.

13. The invention of claim 11 wherein the articulated member is attached to the upper surface and has a simulated steering assembly attached to one end.

14. The invention of claim 11 wherein the means for driving the base member include removable power means.

15. The invention of claim 14 wherein the power means includes a housing containing a source of power supported by a pair of wheels, the housing further including mounting means for interconnecting the power means with the base member.

16. The invention of claim 14 wherein the power means includes a watertight housing having an output shaft and a rotatable member attached to the output shaft.

17. The invention of claim 11 wherein the base member further includes a pair of pontoon like members suspended from either side of the base member.

18. The invention of claim 11 wherein the rack member is spring biased to an extended position.

* * * * *